US011713941B1

(12) United States Patent
Crist et al.

(10) Patent No.: US 11,713,941 B1
(45) Date of Patent: Aug. 1, 2023

(54) COCKING MECHANISMS FOR A CROSSBOW

(71) Applicant: Crist Reed Inc., Holley, NY (US)

(72) Inventors: Jeffrey A. Crist, Holley, NY (US); Thomas J. Read, Hilton, NY (US)

(73) Assignee: Crist Reed Inc., Holley, NY (US)

( * ) Notice: Subject to any disclaimer, the term of this patent is extended or adjusted under 35 U.S.C. 154(b) by 0 days.

(21) Appl. No.: 17/738,676

(22) Filed: May 6, 2022

(51) Int. Cl.
*F41B 5/12* (2006.01)
*F41B 5/18* (2006.01)
*F41B 5/14* (2006.01)

(52) U.S. Cl.
CPC ..... *F41B 5/1469* (2013.01); *F41B 5/123* (2013.01)

(58) Field of Classification Search
CPC ..... F41B 5/12; F41B 5/123; F41B 5/1469
USPC ..... 124/25, 86
See application file for complete search history.

(56) References Cited

U.S. PATENT DOCUMENTS 3,043,287 A * 7/1962 Nelson ..... F41B 5/12 124/35.1
3,670,711 A * 6/1972 Firestone ..... F41B 5/12 124/35.1
4,593,675 A * 6/1986 Waiser ..... F41B 5/12 124/25
4,603,676 A * 8/1986 Luoma ..... F41B 5/123 124/40
4,649,892 A * 3/1987 Bozek ..... F41B 5/12 124/25
4,697,571 A * 10/1987 Waiser ..... F41B 5/12 124/25
4,732,134 A * 3/1988 Waiser ..... F41B 5/12 124/25

(Continued)

FOREIGN PATENT DOCUMENTS

TW 201809585 A 3/2018

OTHER PUBLICATIONS

Pedia Content Solutions Pvt. Ltd. (2021) "State Intellectual Property Office of China Releases Yang Hongkai's Patent Application for Repeating Type Crossbow Applied to Shooting Playgrounds," 6 pages, Global UP News, Sports Patent News, retrieved from <https://dialog.proquest.com/professional/docview/2491904250/17ADF699701FFBBFFD/1?accountid=157282>.

(Continued)

*Primary Examiner* — Alexander R Niconovich
(74) *Attorney, Agent, or Firm* — Brian B. Shaw, Esq.; Harter Secrest & Emery LLP

(57) ABSTRACT

A crossbow is provided with a reciprocating linear rack and a locking linear rack, wherein a traveler having a pawl for each linear rack is engaged by the reciprocating linear rack to move rearward relative to the locking rack, thereby moving the traveler to a drawn position. A cocking lever is hand operated by the user though a plurality of cycles to move the traveler, and captured bowstring to a fully drawn configuration. A trigger mechanism engage the traveler in the drawn configuration and selectively releases the bowstring from the traveler. A bow assembly is provided, wherein the bowstring wraps about a front edge of opposing rotatable members, to be longitudinally located in front of a portion of power cables. The bow assembly includes a power cable on each side of the stock, and thus the power cables do not cross a longitudinal axis of the crossbow.

16 Claims, 9 Drawing Sheets

(56) References Cited

U.S. PATENT DOCUMENTS

| | | | | |
|---|---|---|---|---|
| 4,942,861 | A * | 7/1990 | Bozek | F41B 5/12 124/35.1 |
| 5,115,795 | A * | 5/1992 | Farris | F41B 5/14 124/25 |
| 5,156,138 | A | 10/1992 | Grover | |
| 5,220,906 | A * | 6/1993 | Choma | F41B 5/12 74/89.37 |
| 5,823,172 | A * | 10/1998 | Suggitt | F41B 5/12 124/25 |
| 6,095,128 | A * | 8/2000 | Bednar | F41B 5/123 124/25 |
| 6,286,496 | B1 * | 9/2001 | Bednar | F41B 5/123 124/25 |
| 6,705,304 | B1 * | 3/2004 | Pauluhn | F41B 5/12 124/25 |
| 6,799,566 | B1 * | 10/2004 | Malucelli | F41B 5/12 124/25 |
| 6,874,491 | B2 * | 4/2005 | Bednar | F41B 5/1469 124/25 |
| 6,913,007 | B2 * | 7/2005 | Bednar | F41B 5/1469 124/25 |
| 7,017,568 | B1 * | 3/2006 | Smith | F41B 5/1469 124/25 |
| 7,100,590 | B2 | 9/2006 | Chang | |
| 7,784,453 | B1 * | 8/2010 | Yehle | F41B 5/1469 124/25 |
| 7,810,480 | B2 * | 10/2010 | Shepley | F41B 5/1469 124/25 |
| 8,240,299 | B2 * | 8/2012 | Kronengold | F41B 5/123 124/90 |
| 8,443,790 | B2 * | 5/2013 | Pestrue | F41B 5/12 124/25 |
| 8,485,170 | B1 | 7/2013 | Prior | |
| 8,499,753 | B2 * | 8/2013 | Bednar | F41B 5/12 124/25 |
| 8,863,732 | B1 | 10/2014 | Prior | |
| 9,273,922 | B2 * | 3/2016 | Hudkins | F41B 5/123 |
| 9,341,432 | B1 * | 5/2016 | Wohleb | F41B 5/1469 |
| 9,341,434 | B2 * | 5/2016 | McPherson | F41B 5/123 |
| 9,494,381 | B1 * | 11/2016 | Jeske | F41B 5/1469 |
| 9,528,792 | B1 | 12/2016 | Chang | |
| 9,599,425 | B2 * | 3/2017 | Barnett | F41B 5/1469 |
| 9,714,808 | B2 * | 7/2017 | Carroll, Jr. | F41B 5/12 |
| 9,746,278 | B1 * | 8/2017 | Chang | F41G 1/467 |
| 9,958,232 | B1 * | 5/2018 | Egerdee | F41B 5/1403 |
| 10,077,965 | B2 * | 9/2018 | Yehle | F41B 5/10 |
| 10,139,188 | B2 * | 11/2018 | Shaffer | F41B 5/12 |
| 10,175,023 | B2 * | 1/2019 | Yehle | F41B 5/123 |
| 10,260,835 | B2 * | 4/2019 | Pulkrabek | F41B 5/123 |
| 10,408,558 | B2 * | 9/2019 | Thalberg | F41B 5/12 |
| 10,421,637 | B1 * | 9/2019 | Huang | F41B 5/123 |
| 10,458,743 | B1 * | 10/2019 | Kempf | F41B 5/123 |
| 10,690,436 | B1 * | 6/2020 | Kempf | F41B 5/1469 |
| 10,900,737 | B1 * | 1/2021 | Hensel | F41B 5/12 |
| 10,948,257 | B1 * | 3/2021 | Huang | F41B 5/1449 |
| 11,015,892 | B1 * | 5/2021 | Jessup | F41A 17/20 |
| 11,131,524 | B1 * | 9/2021 | Kempf | F41B 5/123 |
| 11,156,429 | B1 * | 10/2021 | Kempf | F41B 5/12 |
| 11,221,191 | B2 * | 1/2022 | Bednar | F41B 5/1469 |
| 11,268,781 | B1 * | 3/2022 | Kempf | F41B 5/12 |
| 11,512,924 | B1 * | 11/2022 | Xiao | F41B 5/123 |
| 2006/0086346 | A1 * | 4/2006 | Middleton | F41B 5/12 124/25 |
| 2010/0170488 | A1 * | 7/2010 | Rasor | F41A 19/12 124/35.1 |
| 2022/0381532 | A1 * | 12/2022 | Barnett | F41B 5/14 |

OTHER PUBLICATIONS

Snake Eye Tactical (2020) "Snake Eye Tactical Cobra System Self Cocking Pistol Tactical Crossbow, 80-Pound," 8 pages, retrieved from <https://www.amazon.com/Snake-Eye-Tactical-Crossbow-80-Pound/dp/B07S1RDC21?th=1>.

* cited by examiner

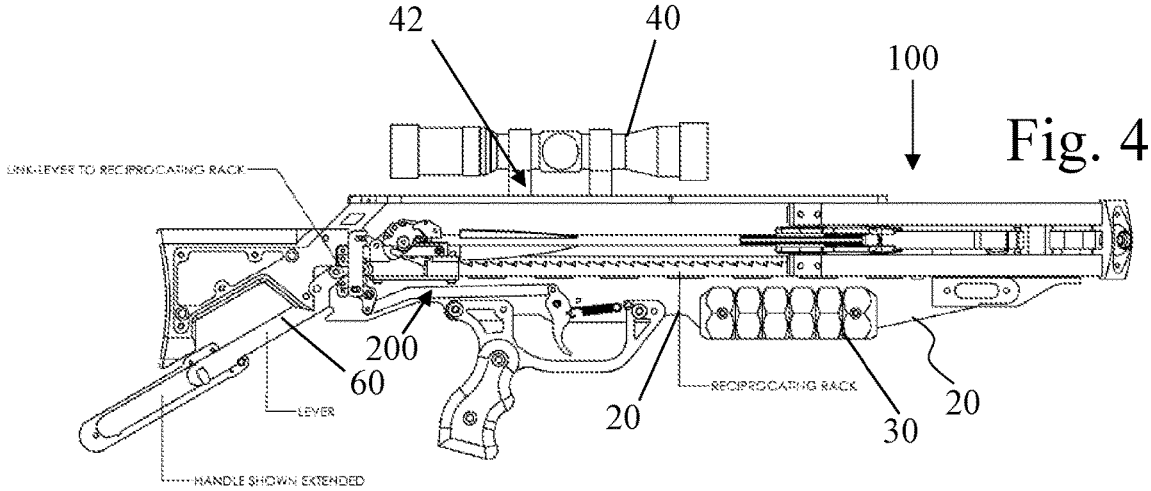
Fig. 4
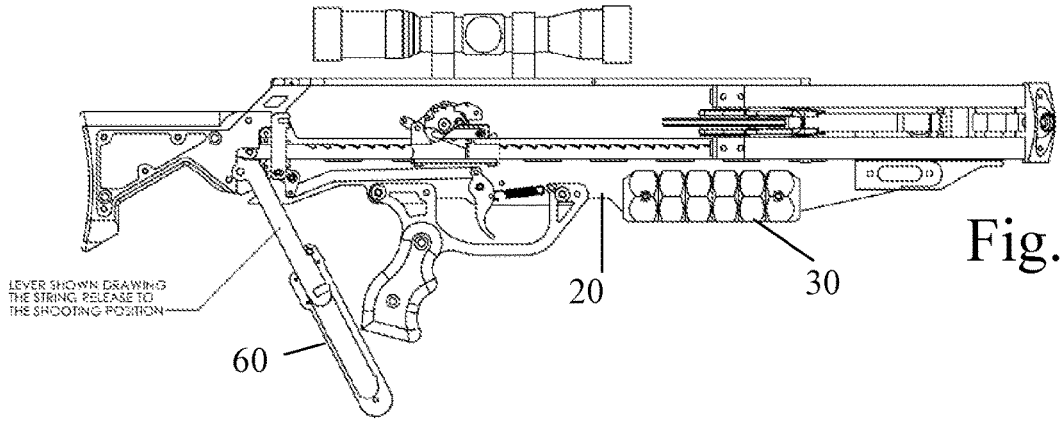
Fig. 5
Fig. 6
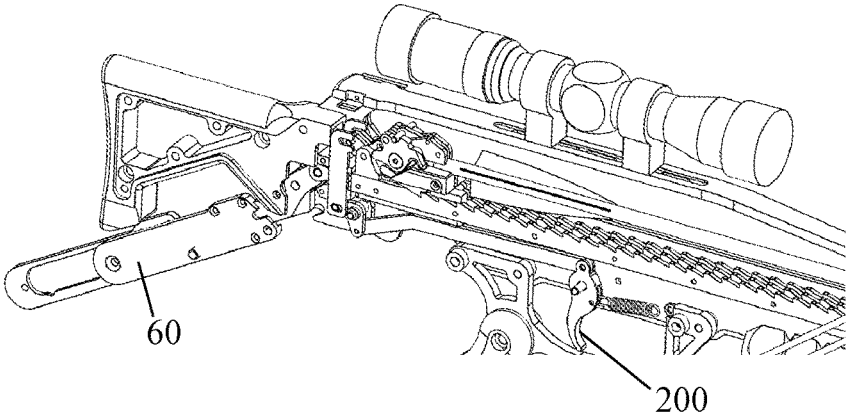

Fig. 12
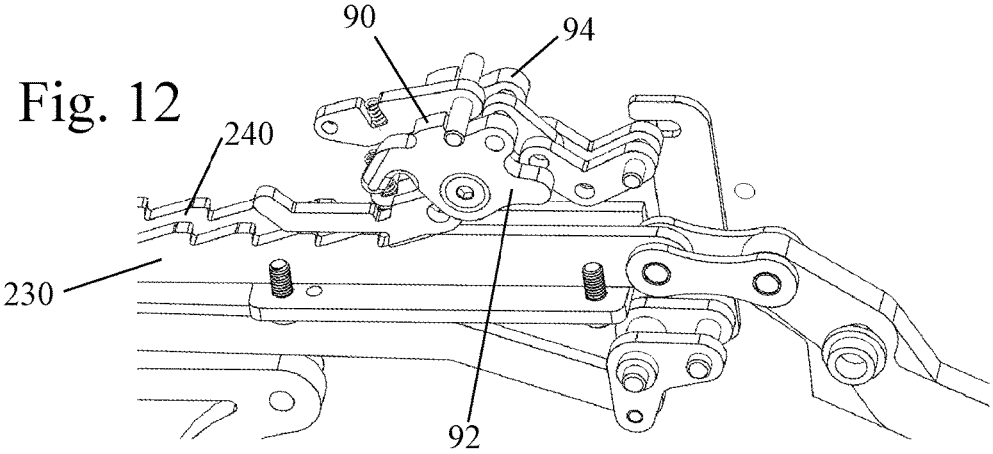
Fig. 13
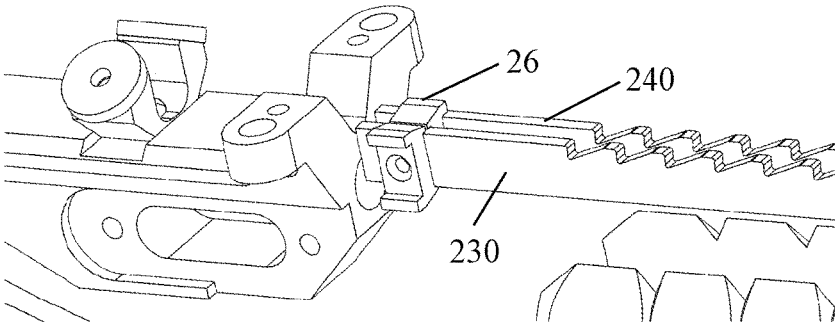
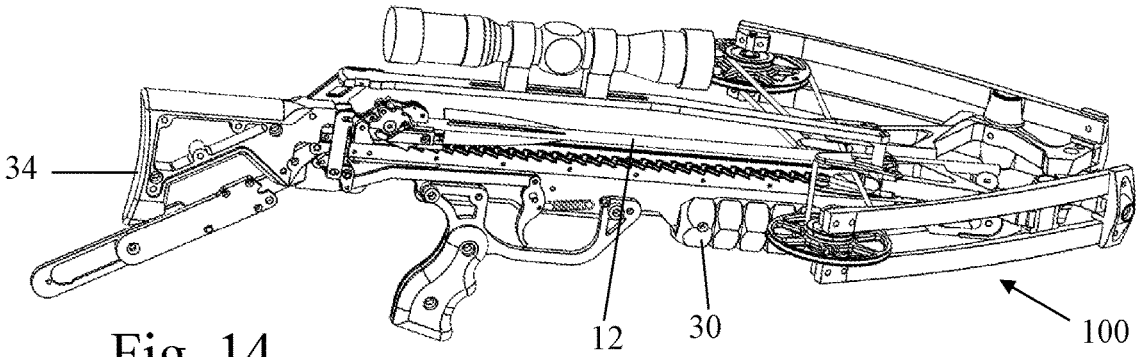
Fig. 14

Fig. 18
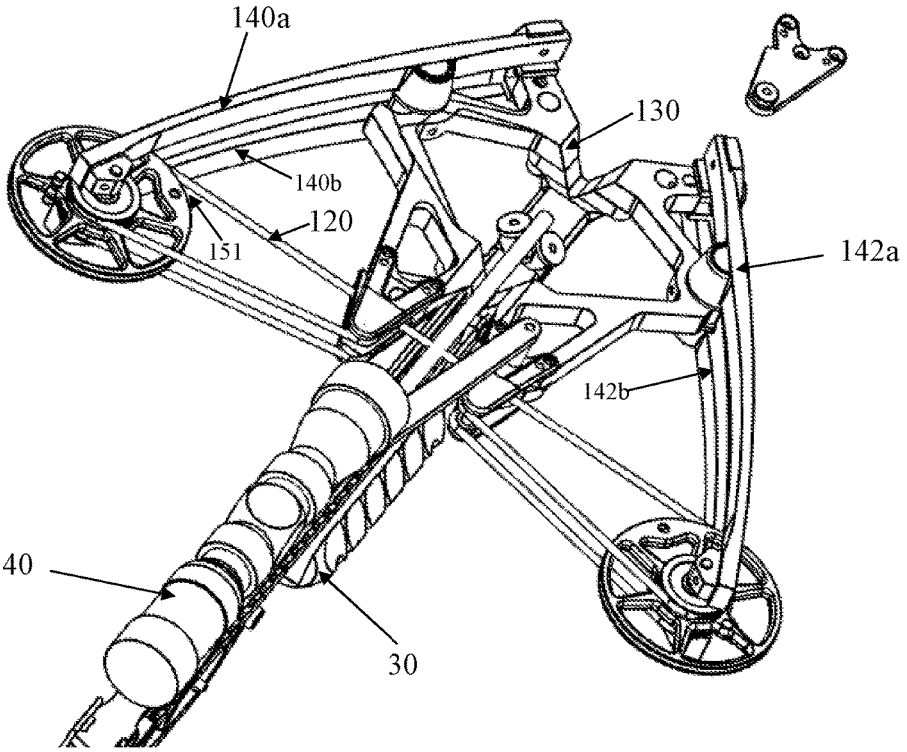
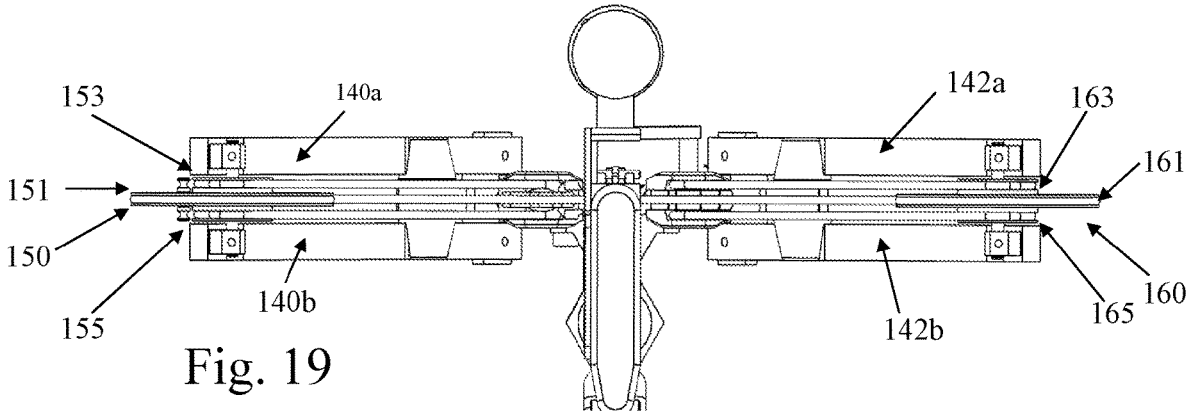
Fig. 19

COCKING MECHANISMS FOR A CROSSBOW

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A SEQUENCE LISTING

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present disclosure relates to a crossbow, and particularly to a crossbow having a reciprocating linear rack and a bow assembly configured for drawing a bowstring.

Description of Related Art

Bows have been used for many years as a weapon for hunting and target shooting. More advanced bows include cams that increase the mechanical advantage associated with the draw of the bowstring. The earns are configured to yield a decrease in draw force near full draw.

Crossbows are well known projectile devices that have been around for centuries. During most of that time, the basic structure of the crossbow has remained relatively unchanged, with modifications to the trigger mechanism, changes in the materials used in its construction and many innovations in devices and mechanisms for drawing the bowstring into the cocked position. A large amount of time an effort has been expended on developing a simple and easily used cocking mechanism over the years. However, each has been less than satisfactory. The simplest form of cocking is performed manually. The bow string is grasped by hand or hands, and drawn to the cocked position. This method is simple and quick, but becomes more difficult as the draw weight of the bow increases. Claws, hooks, etc. with handles, are often utilized to provide a better grip on the bow string. However, strength is still needed to draw the bow string. Over the years external mechanical aids have also been developed. These, however, are typically bulky, difficult to use and inconvenient to carry with the crossbow.

More successful are devices that are attached to or carried by the crossbow. These devices include cranks and levers for drawing the bow string into the cocked position. Cranks most simply pull a line connected to the bow string onto a spindle. Levers employ one or more lever elements to pull the bow string back. Each is effective, but can be cumbersome and awkward to employ.

It would be highly advantageous, therefore, to remedy the foregoing and other deficiencies inherent in the prior art.

In order to cock a bow in preparation for firing the same, the string must be pulled toward a trigger assembly. Sufficient force must be exerted to bend the limbs of the bow which carry the string. Then an arrow may be loaded in the crossbow with its back end in contact with the string, the trigger safety may be disengaged, and the trigger pulled to release or shoot the arrow.

The force required to cock the bow in this fashion has consistently been a problem for users. Specifically, despite the use of compound bows with cams that attach the string to the limbs, the force required to cock a typical bow often exceeds one hundred pounds. As a result, many devices have been designed to assist in the cocking of a crossbow.

The most sophisticated of these devices is an essentially automatic cocking machine which is attached to the stock of a bow and by means of a motorized rope system. In lieu of being motorized, these cocking devices can also be operated by means of a hand crank. While these automatic or hand cranked devices operate satisfactorily, they are somewhat expensive, add additional weight, and they are bulky when attached to the stock of the bow.

The use of crossbows for hunting has increased in recent years, especially for those who are elderly, disabled or young, where using a traditional bow or a compound bow may be too physically strenuous. Indeed, crossbows offer these individuals an opportunity to hunt or shoot a bow much more easily. For others, shooting with crossbows may offer variety over using only a traditional bow, or they may simply enjoy using a crossbow.

However, crossbows in general have a very large drawing force, making them difficult to cock without the use of force-multiplying tools. This difficulty is especially true for elderly, disable and young users that may not have the necessary strength and dexterity to cock the crossbow.

BRIEF SUMMARY OF THE INVENTION

The present disclosure provides a crossbow having a stock extending along a longitudinal direction; a limb connected to the stock and moveable between a cocked position and a fired position; a bowstring connected to the limb; a trigger mechanism connected to the stock; a traveler moveable along the stock from a fired position to a cocked position, wherein the traveler includes (i) a string capture surface, (ii) a cocking pawl, and (iii) a first locking pawl; a first locking linear rack fixed relative to the stock and extending along the longitudinal direction, the first locking linear rack having a first plurality of teeth configured to cooperatively engage the locking pawl; a reciprocating linear rack moveably connected to the stock through a cocking cycle, the cocking cycle having an advancing portion and a releasing portion, the reciprocating linear rack including a plurality of teeth configured to engage the cocking pawl; and a hand lever connected to the reciprocating linear rack and configured to move the reciprocating linear rack through the cocking cycle.

The present disclosure further provides a crossbow having a stock extending along a longitudinal direction; a first locking linear rack fixedly connected to the stock, the first locking linear rack having a first plurality of teeth; a reciprocating linear rack moveably connected to the stock and configured to move through a cocking cycle having an advancing portion of the cocking cycle and a releasing portion of the cocking cycle, the reciprocating linear rack having a second set of teeth; a traveler moveable along the stock from a fired position to a cocked position, wherein the traveler includes (i) first locking linear rack engaging surface configured to engage the first plurality of teeth and (ii) a reciprocating linear rack engaging surface configured to engage the second set of teeth; and a hand lever connected to the reciprocating linear rack and configured to move the reciprocating linear rack through at least a portion of the cocking cycle.

A method is provided of cocking a crossbow, including the steps of engaging a first portion of a traveler with a reciprocating linear rack moveably connected to a stock; moving the reciprocating linear rack through an advancing portion of a cocking cycle to move the traveler and the reciprocating linear rack relative to a first locking linear rack fixedly connected to the stock; engaging a second portion of the traveler with the first locking linear rack; and moving the reciprocating linear rack through a releasing portion of the cocking cycle relative to the first locking linear rack and the traveler.

The disclosure further provides a crossbow having a stock extending along a longitudinal axis; a riser connected to the stock; a left limb connected to the riser and a right limb connected to the riser; a left rotatable member rotatably connected to the left limb about a first axis and a right rotatable member rotatably connected to the right limb about a second axis, wherein the first axis is parallel to the second axis, and orthogonal to the longitudinal axis and the left rotatable member includes a left peripheral bowstring groove, a left upper cable groove, and a left lower cable groove, the right rotatable member includes a right peripheral bowstring groove, a right upper cable groove and a right lower cable groove; a bowstring extending between a front edge of the left peripheral bowstring groove and a front edge of the right peripheral bowstring groove; a left cable bracket on a left side of the stock and a right cable bracket on a right side of the stock, each of the left cable bracket and the right cable bracket having a lower corner post, an upper corner post and a turn post, wherein each lower corner post is coplanar with the first and second lower cable groove and each upper corner post is coplanar with the first and second upper cable groove; a right power cable extending from a rear of the right lower cable groove to the lower corner post of the right cable bracket to the turn post of the right cable bracket to the upper corner post of the right cable bracket to a rear of the right upper cable groove; and a left power cable extending from a rear of the left lower cable groove to the lower corner post of the left cable bracket to the turn post of the left cable bracket to the upper corner post of the left cable bracket to a rear of the left upper cable groove.

The disclosure also includes a crossbow having a stock extending along a longitudinal direction and including a slide bar; a limb connected to the stock and moveable between a cocked position and a fired position; a bowstring connected to the limb; a trigger mechanism connected to the stock; a traveler moveable along the stock from a fired position to a cocked position, wherein the traveler includes a string capture surface, and a handle/grip assembly, the handle/grip assembly having a driving lever, and a braking lever normally engaging the slide bar, the braking lever when engaging the slide bar preventing motion of the slide bar relative to the handle/grip assembly in in first direction, and when disengaging the slide bar allowing advancement of the handle/grip assembly in in first direction, the braking lever having an engaging portion extending outwardly from a hand grip, a trigger handle pivotably mounted to the hand grip rearwardly of the braking lever and contacting the driving lever, the engaged driving lever moving the slide bar and a second direction opposite the first direction, the handgrip having a trigger-type relationship with a trigger handle.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

FIG. 4 is a side elevational view of the crossbow of FIG. 1 with an arrow in a cocked position.

FIG. 5 is a side elevational view of the crossbow of FIG. 4 with a traveler in an intermediate position.

FIG. 6 is a perspective view of a rear portion of the crossbow with an arrow is a cocked position.

FIG. 12 is a left side perspective view of the traveler in the cocked position relative to the reciprocating linear ratchet, wherein select components of the crossbow are eliminated for clarity.

FIG. 13 is a left side perspective view of a front portion of the crossbow showing the guide for the reciprocating linear rack, wherein additional components of the crossbow are eliminated for clarity.

FIG. 14 is a left side perspective view of the crossbow, wherein select components of the crossbow are eliminated for clarity.

FIG. 18 is perspective view of the bow assembly of the crossbow showing the draw string and power cable relative to a longitudinal axis.

FIG. 19 is a rear elevational view of the crossbow.

DETAILED DESCRIPTION OF THE INVENTION

Figure 1:
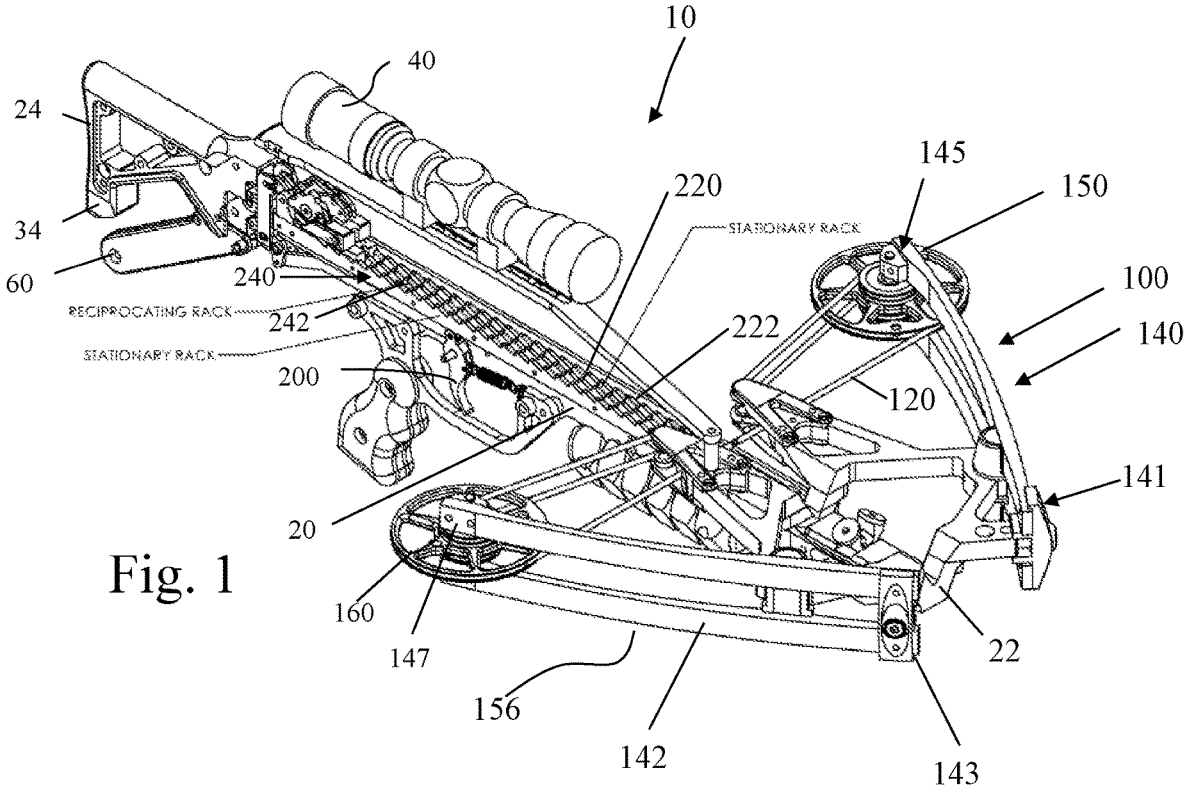
FIG. 1 is a perspective view of a crossbow.

Generally, the present disclosure is directed to a cocking mechanism and a bow mechanism for a crossbow 10 for selecting launching a projectile such as a bolt or arrow 12.

Referring to FIGS. 1, 2, 4, and 5, the crossbow 10 generally includes a stock 20, a bow assembly 100, and a trigger assembly 200. It is understood other crossbow components can be optionally used with the presently described crossbow. For example, in select configurations, the crossbow 10 may include a scope 40 attached to a scope mount 42 that is supported on the stock 20.

The stock 20 is a longitudinal structural member of the crossbow 10 extending along a longitudinal axis, sometimes (referred to as) a shooting axis, from a front end 22 to a rear end 24 to define a longitudinal dimension and is configured to support the bow assembly 100 and the trigger assembly 200, and often other components as well. The stock 20 can include a foregrip 30, configured to receive an aiming hand, wherein the foregrip can include removable foregrips or collapsible foregrips. In select configurations, the stock 20 can include or couple with a buttstock 34 configured to contact a shoulder of the user. The stock 20 thus has the front end 22 nearer a target and the rear end 24 nearer the user, wherein the bolt 12 travels toward the front end to be launched by the crossbow.

The stock 20 can further include or carry a barrel 36, used to guide the projectile being shot or fired by the weapon. The barrel 36 is also known as a rail or track, and can include a grooved track on top that aligns a bolt with a bowstring. Referring to the Figs., the barrel 36 can be defined by a pair of runners 38, wherein the runners are configured to slideably engage the bolt as the bolt is propelled from the crossbow.

The bow assembly 100 includes a bow 110 and a bowstring 120 that shoots or propels the arrow 12 powered by the elasticity of the bow and the drawn bowstring. The bow assembly 100 can include a riser 130 coupling the bow 110 to the stock 20. The bow assembly 100 includes a resilient bent, curved, or arched object, such as but not limited to limbs 140, 142 mounted to the stock 20 or the riser 130. For purposes of the present description, the limbs 140, 142 are set forth as connected to the riser 130. However, it is understood, the limbs 140, 142 can be connected to the stock 20.

Each limb 140, 142 has one end 141, 143 anchored to the riser 130 and at another end 145, 147 an axle supporting a respective rotatable member 150, 160, such as a cam, or wheel. In one configuration, the limbs 140, 142 are formed of an upper limb 140*a*, 142*a* and a lower limb 142*a*, 142*b*, often referred to as split limbs, with the corresponding rotatable member 150, 160 is located between the upper and lower limbs. For purposes of description, the limbs 140, 142 are set forth as a left (or first) limb 140 and a right (or second) limb 142 opposite the left limb.

The bowstring 120 includes a string or cord attached to or moved by the limbs 140, 142. Thus, the bowstring is generally movable between a drawn (or cocked) position and a fired (or released) position. The Figs. illustrate a compound bow which includes the bow assembly 100 having the rotatable members 150, 160, such as wheels, pulleys, or cams at each end of the bow, or limb 140, 142. through which the bowstring passes. However, it is understood the present system is not limited to a compound bow.

The left (or first) limb 140 is operably engaged with the left, or first, rotatable member 150, such as a left cam, rotatable about a first axis and the right limb 142 is operably engaged with the right rotatable member 160, such as a right cam rotatable about a second axis. The first axis and the second axis are parallel to each other and orthogonal to the longitudinal axis of the stock 20. The left rotatable member 150 is identical to the right rotatable member 160.

Each rotatable member 150, 160 includes a peripheral bowstring groove 151, 161, an upper peripheral cable groove 153, 163 and a lower peripheral cable groove 155, 165. In one configuration, the bowstring groove 151, 161 defines a larger radius from the respective axis of rotation than the upper and lower cable groove 153, 155 and 163, 165. As seen in FIGS. 14, 15, 17, and 18, the bowstring groove 151, 161 is vertically intermediate the upper cable groove 153, 163 and the lower cable groove 155, 165.

In one configuration, the bowstring groove 151 of the left rotatable member 150 and the bowstring groove 161 of the right rotatable member 160 are coplanar and occupy a common plane with the shaft of the arrow 12 and hence path of the bowstring 120 between a cocked configuration and a fired configuration.

A left side of the riser 130 includes a left cable bracket 131 and a right side of the riser includes a right cable bracket 132, each cable bracket defining a lower corner post 133, 134, an upper corner post 135, 136, and turn post 137,138. Thus, the crossbow 10 includes the left lower corner post 133, the left upper corner post 135 and the left turn post 137, and the right lower corner post 134, a right upper corner post 136, and a right turn post 138, wherein the rotatable member 150, 160 on a given side of the stock 20 is laterally spaced further from the stock than the lower corner post 133, 134, the upper corner post 135, 136 and the turn post 137, 138 on that side of the stock. The upper corner posts 135, 136 and the lower corner posts 133, 134 are located at a given position along the longitudinal axis, wherein the respective turn post 137, 138 is located forward of the given position, or closer to the front end 22 of the stock 20. The forward edge of the bowstring rotatable member 150, 160 is positioned longitudinally intermediate upper/lower corner posts 133, 134/135,136 and the respective turn posts 137,138. In one configuration, the turn posts 137,138 are located longitudinally forward of the front edge of the bowstring groove 151, 161 in each rotatable member 150, 160.

Each of lower corner post 133, 134 and upper corner post 135, 136 have a peripheral guide groove 133*a*, 134*a* and 135*a*, 136*a*, wherein the plane of the peripheral guide groove in the lower corner post is coplanar with the plane of the groove of the lower cable guide 155, 165 and the plane of the peripheral guide groove in the upper corner post is coplanar with the plane of the groove of the upper cable guide 153, 163. Thus, the plane of the peripheral bowstring groove 151, 161 is vertically intermediate (i) the lower cable guide groove 155, 165 and the lower corner post 133, 134 and (ii) the upper cable guide groove 153, 163 and the upper corner post 135,136.

The bowstring 120 is attached to each rotatable member 150, 160 and rides in the corresponding peripheral bowstring groove 151, 161 in each of the members to pass along the front side of the left rotatable member 150 to the front side of the right rotatable member 160.

As seen in FIGS. 14-19, a first or left power cable 170 is attached to the left lower cable guide groove 155 in the left rotatable member 150 to pass from the rear edge of the left lower cable guide toward the longitudinal axis and about the left lower corner post 133. From the left lower corner post 133, the left power cable 170 extends forward to pass about the left turn post 137 thereby going from the plane of the left lower cable guide groove 155 to the plane of the left upper cable guide groove 153. The left power cable 170 then passes from upper edge of the left turn post 137 to extend rearward to the left upper corner post 135, from which the left power cable extends to be seated in the left upper cable guide groove 153 along the rear edge and connect to the left rotatable member 150.

Similarly, a second or right power cable 172 is attached to the right lower cable guide groove 165 in the right rotatable member 160 to pass from the rear edge of the right lower cable guide groove to pass toward the longitudinal axis and about the right lower corner post 134. From the right lower corner post 134, the right power cable 172 passes forward to pass about the right turn post 138 thereby going from the plane of the right lower cable guide groove 165 to the plane of the right upper cable guide groove 163. The right power cable 172 then passes from upper edge of the right turn post 138 to extend rearward to the right upper corner post 136, from which the right power cable extends to be seated in the right upper cable guide groove 163 along the rear edge and connect to the right rotatable member 160.

Accordingly, the power cables 170, 172 for the crossbow 10 are two separate cables, one for each lateral side of the stock 20. Each power cable 170, 172 is wrapped about its respective side and the corresponding turn post, such that each power cable functions as two cables as each power cable is self adjusting (or balancing) to meet the necessary length—whereas two separate cables on each side of the stock 20 might be of differing lengths and corresponding control the position of the limbs. The power cables 170, 172 are further configured to pass the bowstring 120 between the cable posts, thereby providing a longer power stroke without correspondingly increasing the length of the crossbow. Further, the configuration of the riser 130 and the power cables 170, 172 eliminate the need for a bridge in the crossbow. Thus, the present configuration is free of synchronizing pulleys and cables crossing the stock 20. That is, the power cables 170, 172 do not cross the medial plane of the stock 20 and thus do not cross the arrow 12 or the flight path of the arrow.

Further, the line (and plane) of travel of the bowstring 120 from the cocked (drawn) configuration to the fired configuration is parallel to the motion of the arrow 12 relative to the stock 20. That is, there is no vector of the imparted force from the released bowstring 20 on the arrow 12 that acts non-parallel to a longitudinal axis of the arrow or the longitudinal dimension of the stock.

As seen in FIGS. 15-17, and 18, in the fired configuration, the bowstring 120 crosses and intersects the longitudinal or shooting axis to pass from the bowstring groove 151 in the left rotatable member 150 to extend to the bowstring groove 161 in the right rotatable member 160 above the stock 20, and vertically intermediate the elevation of the upper corner post 135, 136 and the lower corner post 133, 134 of each riser. Thus, a draw length extends from the line extending between the bowstring string groove 151, 161 at the front edge of the left and the right rotatable member 150, 160 rearward to the nocking point on the bowstring 120. That is, rather than the front end of the draw length of the bowstring 120 being longitudinally located at the longitudinal position rearward the rear edge of the bowstring groove 151, 161 in the rotatable member 150, 160, the front end of the draw length of the bowstring is longitudinally located at the longitudinal position of the front edge of the bowstring groove 151, 161 of each rotatable member. Thus, the present configuration increase the draw length by the diameter (or longitudinal dimension) of the rotatable member 150, 160.

Further, as set forth above, the draw length of the bowstring 120 is planar and is coplanar with the bowstring groove 151, 161 in the rotatable members 150, 160.

The trigger assembly 200 is connected to the stock 20 and configured to selectively hold and release the bowstring 120. The trigger assembly 200 includes a release mechanism 210 for selectively retaining the bowstring 120 in the cocked position engaged with the nock. The engagement of the bowstring 120 with nock lies in the plane of the bowstring groove 151 of the first rotatable member 150 and the bowstring groove 161 of the second rotatable member 160, as well and the shooting axis.

Figure 7:
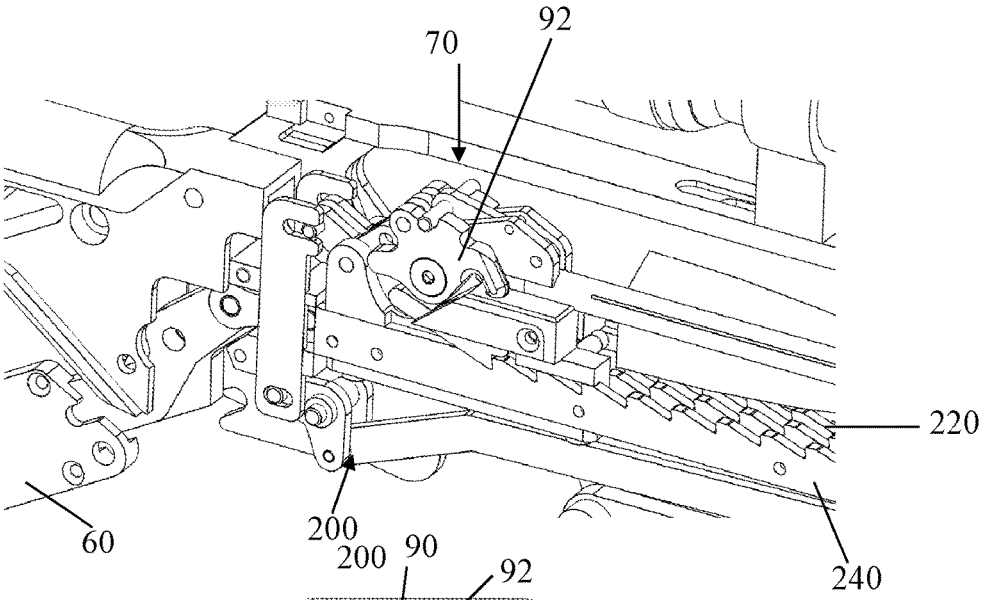
FIG. 7 is an enlarged perspective view of a rear portion of the crossbow with an arrow is a cocked position.
Figure 8:
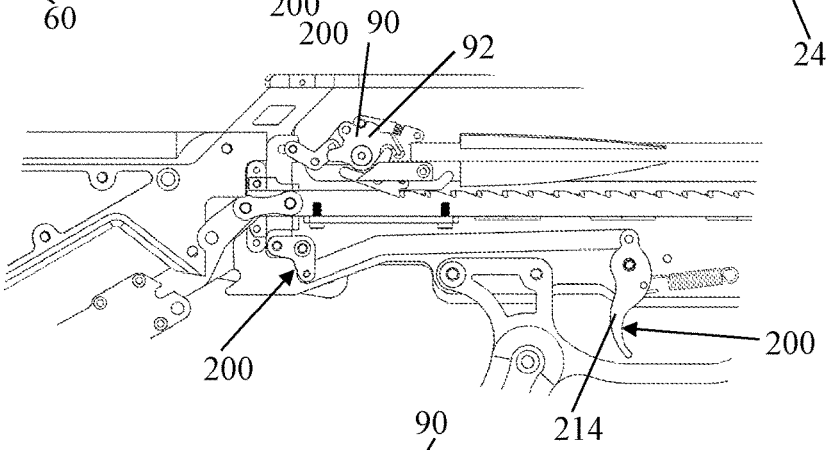
FIG. 8 is a side elevational view of a rear portion of the crossbow with an arrow is a cocked position.
Figure 9:
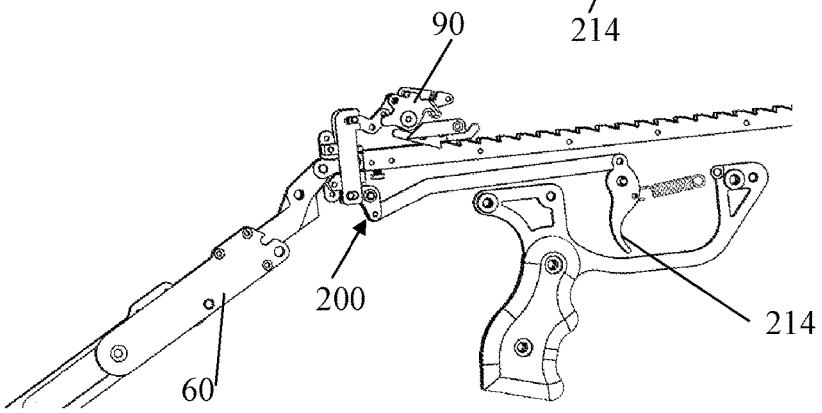
FIG. 9 is a right side elevational view of components of the ratchets in the crossbow of FIG. 1.
Figure 10:
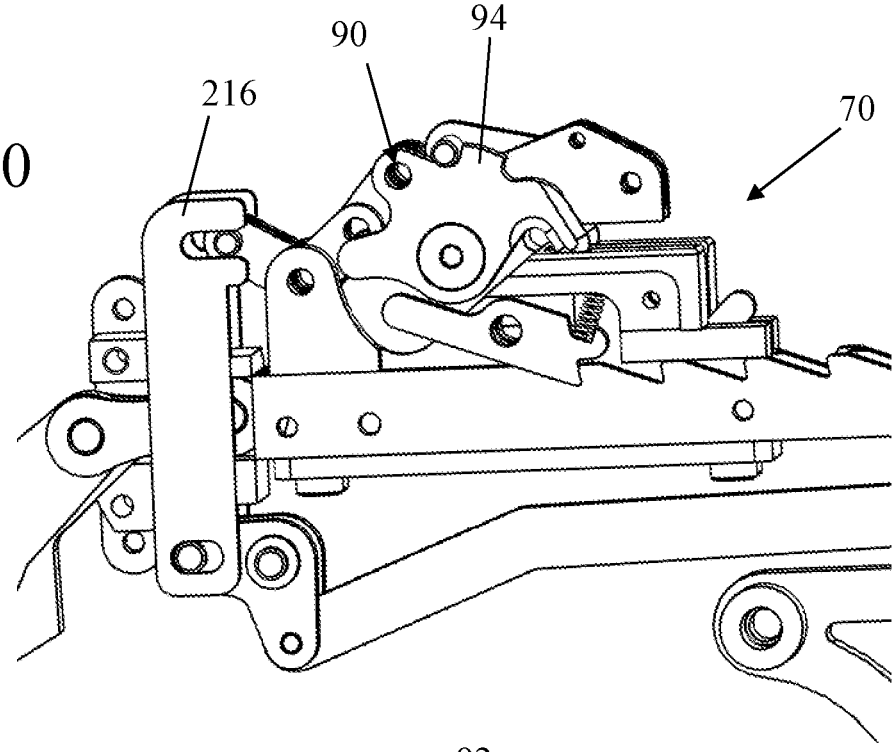
FIG. 10 is a right side perspective view of the traveler in the cocked position relative to a stationary linear ratchet.

Generally, the bowstring 120 may be selectively positionable into a cocked or drawn position, as shown in FIGS. 6 and 7, and an un-cocked or relaxed position, as shown in FIGS. 14-17. Thus, the bowstring 120 may be strung between the distal ends of the limbs 140, 142 such that as the bowstring is drawn and held by the trigger assembly 200 in the cocked or drawn position, the limbs 140, 142 are tensioned, thereby storing energy, that is released upon release of the bowstring 120 from the trigger mechanism 200, to propel the arrow.

With continued reference now to FIGS. 7-12, the trigger assembly 200 may be associated a traveler 70 and with the stock 20 and may comprise any type of trigger assembly known in the art for selectively holding and releasing the bowstring. The trigger assembly 200 generally includes a guide 212 and a user-actuated trigger lever 214. The bowstring 120 may be retracted to and held within a string capture surface 90 in the drawn position by a sear or pivotal string latch 216. The trigger lever 214 can be pulled to selectively release the sear 216, thereby causing the string capture surface 90 to rotate and the bowstring 120 to be released to propel the arrow 12 along the stock 20.

The traveler 70 includes the string capture surface 90 in the shape of a finger rotatably mounted to the traveler between a capture position and a release position. The string capture surface 90 can include a first plate 92 and a second plate 94 rotatably connected to the traveler 70. In one configuration, the first plate 92 and the second plate 94 are parallel and spaced apart. The string capture surface 90 is connected to the trigger mechanism 200 though a linkage, wherein the linkage is configured to rotate the string capture surface 90 as the trigger is moved to a fired position. As seen particularly in FIGS. 10 and 11, the string capture surface 90 is configured to rotate a portion of the finger about a portion of the bowstring 120 to trap the portion of the bowstring, thereby temporarily securing the portion of the bowstring 120 to the traveler 70.

Figure 3:
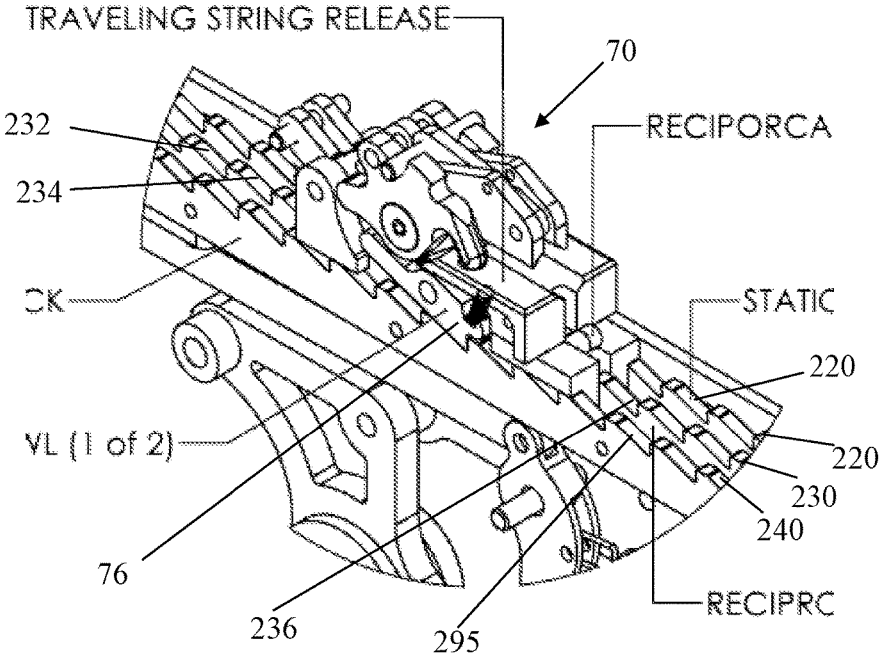
FIG. 3 is an enlarged portion of FIG. 2 of area A-A.

As seen in FIGS. 1 and 3, the stock 20 includes a first locking linear rack 220 and a second locking linear rack 240, wherein each locking linear rack extends longitudinally along the stock. In one configuration, the first and the second linear locking racks 220, 240 are parallel to each other and the longitudinal axis of the stock 20. The term linear is intended to encompass racks that may include an arcuate portion as well as straight racks. The linear racks having an arcuate or bowed portion are distinguished from circular or round racks.

Each of the first and the second locking linear racks 220, 240 includes a corresponding plurality of teeth 222, 242. As with racks in the art, the teeth 222, 242 are generally saw tooth, each tooth having a ramp 224, 244 and a face 226, 246. The ramp 224, 244 defines a generally inclined surface exposed to the front end 22 (the down range end) of the stock 20 and the face 226, 246 provides an engaging surface defining a generally vertical surface orthogonal to the longitudinal direction of the rack 220, 240 (and stock 20). In one configuration, the teeth 222, 242 of the first and the second linear locking rack 220, 240 are equally located along the longitudinal dimension of the stock 20.

Figure 2:
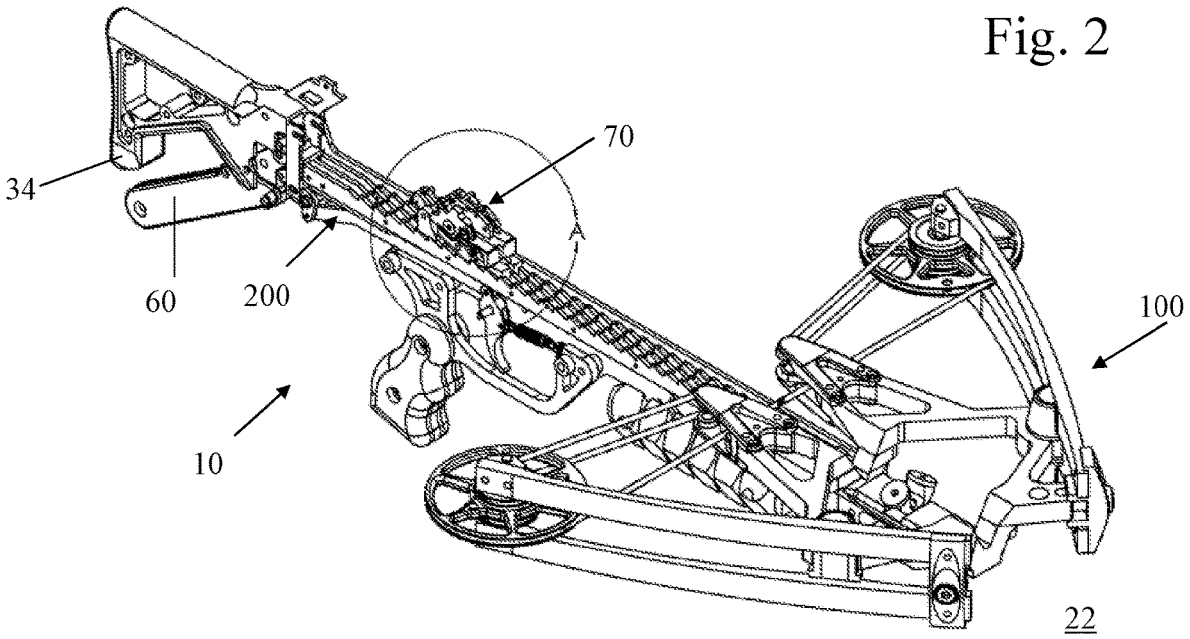
FIG. 2 is a perspective view of a crossbow of FIG. 1, with portions removed for clarity.

The stock 20 also includes a reciprocating rack 230 moveably connected to the stock. The reciprocating rack 230 is moveable through a cocking cycle having an advancing portion and a releasing portion. Further, the reciprocation of the reciprocating rack 230 is not about an axis or pivot point, but rather along the longitudinal axis or direction. In one configuration, the reciprocating rack is a reciprocating linear rack 230, where the cocking cycle is a linear reciprocation of the reciprocating linear rack along the longitudinal dimension of the stock 20. As seen in FIGS. 2 and 3, the reciprocating linear rack 230 is disposed between the first locking linear rack 220 and the second locking linear rack 240. The reciprocating linear rack 230 includes a plurality of teeth 232, wherein as with locking linear racks 220, 240, the teeth are generally saw tooth, each tooth having a ramp 234 and a face 236. The ramp 234 defines a generally inclined surface exposed to the front (the down range end) 22 of the stock 20 and face 236 provides an engaging face defining a generally vertical surface orthogonal to the longitudinal direction of the rack (and stock). In one configuration, the teeth 232 of the reciprocating linear rack 230 are equally located along the longitudinal dimension of the stock 20 with the teeth of the first and the second locking linear rack 220, 240.

Figure 11:
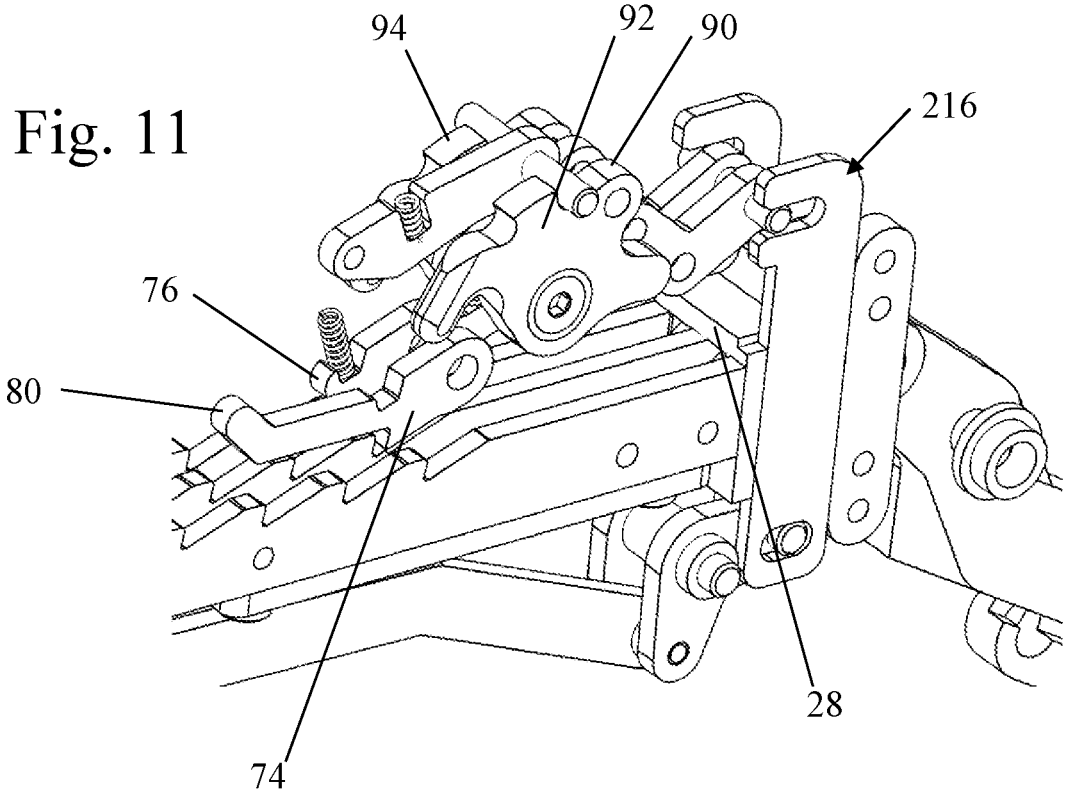
FIG. 11 is a left side perspective view of the traveler in the cocked position, wherein select components of the crossbow are eliminated for clarity.
Figure 15:
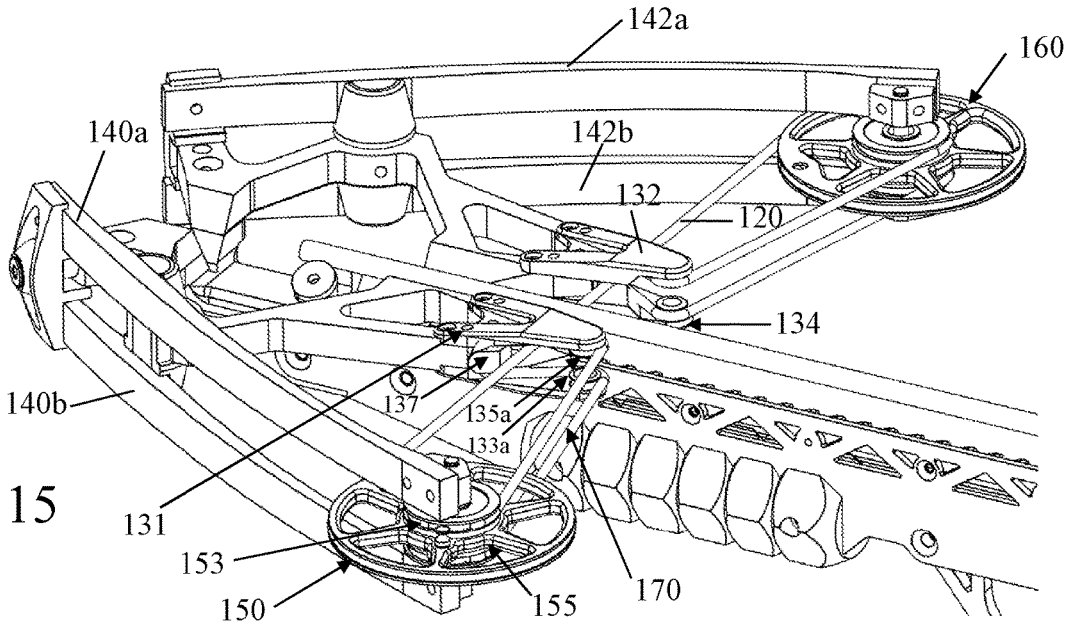
FIG. 15 is an enlarged left side perspective view of the bow assembly, wherein select components of the crossbow are eliminated for clarity.
Figure 16:
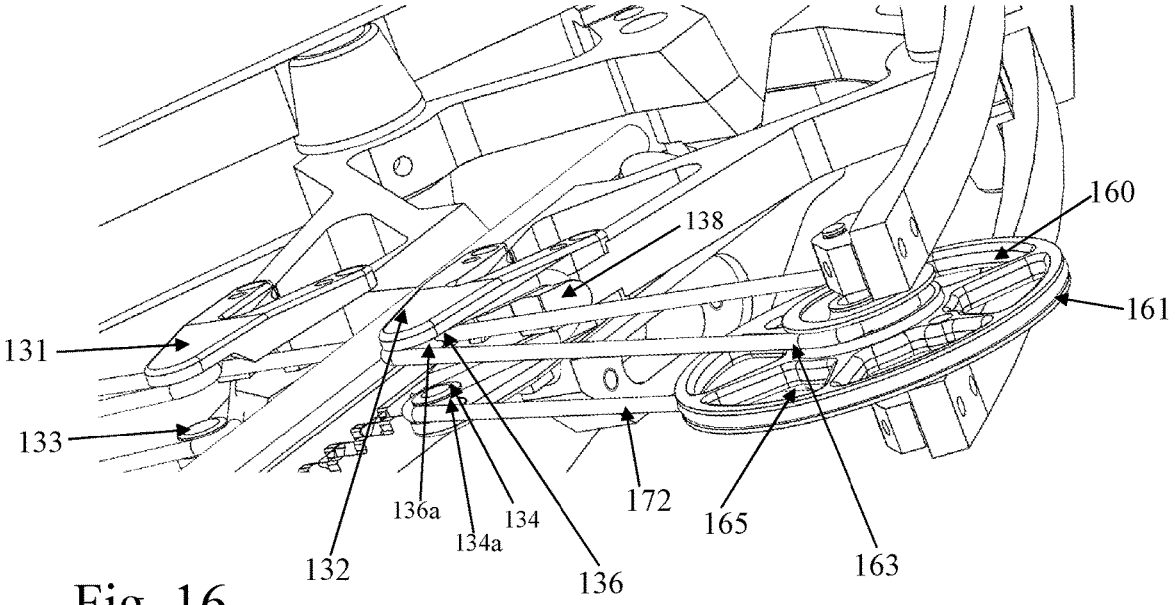
FIG. 16 is an enlarged right side perspective view of the bow assembly, wherein select components of the crossbow are eliminated for clarity.

As seen in FIGS. 11 and 13, the stock 20 includes a front guide 26 and a rear guide 28 sized to slidably receive a portion of the reciprocating linear rack 230. The front guide 26 and the rear guide 28 are configured to provide movement of the reciprocating linear rack 230 along the longitudinal dimension of the stock 20.

A cocking lever 60 is pivotally connected to the stock 20 and moveable through a cocking range of motion from a rest position to a drawn position and back to the rest position. A link 62 is pivotally connected to the cocking lever 60 and the reciprocating linear rack 230. The cocking lever 60 and connection to the stock 20 along with the link 62 are configured to impart linear translation of the reciprocating linear rack 230 relative to the stock as the cocking lever is moved from the rest position to the drawn position, the reciprocating linear rack 230 slides rearward toward the rear end 24 of the stock 20 and slides relative to front guide 26, the rear guide 28, and thus relative to the first and a second locking linear racks 220, 240.

The traveler 70 includes a first (not shown) and a second locking pawl 74, (wherein the first locking panel is a mirror of the second locking panel) and a travelling pawl 76. The first locking pawl 72 engages the first locking linear rack 220, the second locking pawl 74 engages the second locking linear rack 240 and the travelling pawl 76 engages the reciprocating linear rack 230. The pawls 72, 74, 76 are pivotally connected to a body of the traveler 70 and configured to seat on the face 226, 236, 246 of the corresponding linear rack 220, 230, 240. The pawls 72, 74, 76 are biased into a seating or engaging position with the corresponding linear rack 220, 230, 240, such as by a spring.

The traveler 70 further includes a release lever 80 for selectively simultaneously disengaging all the pawls 72, 74, 76 from the corresponding linear rack 220, 230, 240, thereby allowing the traveler to move in the downrange direction relative to the linear racks to the front end 22 of the stock.

Thus, the present disclosure provides the crossbow having the stock 20 extending along the longitudinal axis; the riser 130 connected to the stock; the left limb 140 connected to the riser and the right limb 142 connected to the riser; the left rotatable member 150 rotatably connected to the left limb about a first axis and the right rotatable member 160 rotatably connected to the right limb about a second axis, wherein the first axis is parallel to the second axis, and orthogonal to the longitudinal axis and the left rotatable member includes the left peripheral bowstring groove 151, the left upper cable groove 153, and the left lower cable groove 155, the right rotatable member includes the right peripheral bowstring groove 161, the right upper cable groove 163 and the right lower cable groove 165; the bowstring 120 extending between a front edge of the left peripheral bowstring groove and a front edge of the right peripheral bowstring groove; the left cable bracket 131 on a left side of the stock and the right cable bracket 132 on a right side of the stock, each of the left cable bracket and the right cable bracket having a lower corner post, an upper corner post and a turn post, wherein each lower corner post is coplanar with the first and second lower cable groove and each upper corner post is coplanar with the first and second upper cable groove; the right power cable 172 extending from a rear of the right lower cable groove to the lower corner post of the right cable bracket to the turn post of the right cable bracket to the upper corner post of the right cable bracket to a rear of the right upper cable groove; and the left power cable 170 extending from a rear of the left lower cable groove to the lower corner post of the left cable bracket to the turn post of the left cable bracket to the upper corner post of the left cable bracket to a rear of the left upper cable groove. It is further contemplated the bowstring 120 is moveable between a fired position and a drawn position, and the bowstring in the fired position crosses the longitudinal axis in front of the lower corner post of each of the left cable bracket and the right cable bracket. In a further configuration, the bowstring 120 is moveable between a fired position and a cocked position, and the bowstring in the fired position crosses the longitudinal axis longitudinally intermediate the lower corner post and the turn post of each of the left cable bracket and the right cable bracket. It is contemplated the riser 130 can include a left lateral portion and a right lateral portion.

Figure 17:
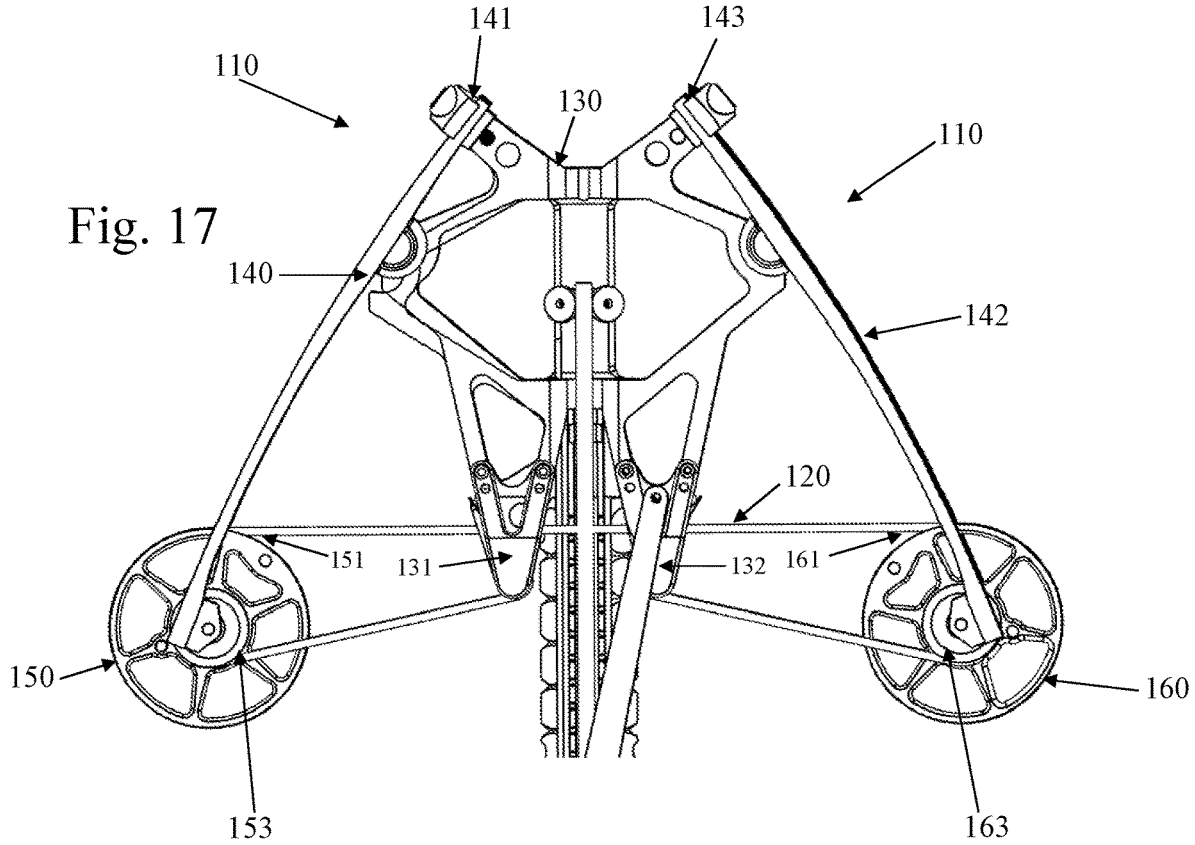
FIG. 17 is a top plan view of the bow assembly of the crossbow.

In operation, the bowstring 120 is movable between fired (released) position FIGS. 17 and 18, and the cocked (drawn) position FIGS. 4 and 6. To dispose the bowstring 120 in the drawn configuration, the release lever 80 of the traveler 70 is raised to disengage each pawl 72, 74, 76 from the corresponding linear rack 220, 230, 240, and the traveler is moved toward the front end 22 of the stock to engage the bowstring in the fired (released) configuration. The bowstring is captured in the string capture surface 90 so as to be coupled to and move with the traveler 70.

The cocking lever 60 is then moved from the rest position to the drawn position, thereby causing the reciprocating linear rack 230 to move rearward relative to the stock 20 and the first and the second locking linear racks 220, 240. As the reciprocating linear rack 230 is moved rearward, one tooth 232 of the reciprocating linear rack engages the travelling pawl 76, thereby moving the traveler 70 rearward. As the cocking lever 60 moves through its range of motion, the locking pawls 72, 74 slide up over the next rearward ramp 224, 244 and are then biased down to engage the corresponding face 226, 246. The cocking lever 60 is then moved to the start position, where rearward motion of the reciprocating linear rack 230 again engages the travelling pawl 76 and the cycle is repeated. This process continues through sufficient cycles until the traveler 70 is brough sufficiently rearward to operably engage the trigger mechanism 200, and the bowstring 120 is in the drawn configuration.

The arrow 12 is then disposed in the barrel and engages the drawn bowstring 120. Actuation of the trigger mechanism 200 moves the linkage connecting the string capture surface 90, causing the string capture surface to rotate and release the drawn bowstring 120. The released drawn bowstring 120 then propels the arrow 12 forward along the runners 38 to fly from the crossbow 10.

In a further configuration, it is contemplated the traveler 70 can cooperate with a handle/grip assembly such as set forth in U.S. Pat. Nos. 4,926,722; 5,009,134; and 5,170,682, each of which is hereby expressly incorporated by reference, wherein the traveler is movable relative to handle/grip assembly or with the handle/grip assembly. In this configuration, the traveler 70 includes the string capture surface 90 rotatably mounted to the traveler between a capture position and a release position. The string capture surface 90 can include the first plate 92 and the second plate 94 rotatably connected to the traveler 70. In one configuration, the first plate 92 and the second plate 94 are parallel and spaced apart. The string capture surface 90 is connected to the trigger mechanism 200 though a linkage, wherein the linkage is configured to rotate the string capture surface 90 as the trigger is moved to a fired position.

Further, in this configuration, the handle/grip assembly, as disclosed in the patents incorporated by reference, can either move with the traveler 70 or relative to the traveler. That is, the handle/grip assembly can be fixed relative to the stock 20 and cause the traveler 70 to engage the bowstring 120 in the fired position and move the traveler relative to the handle/grip assembly to draw the bowstring to the cocked position. Alternatively, the handle/grip assembly can carry the traveler 70 and be configured to move relative to the stock 20. Thus, the handle/grip assembly is moved relative to the stock 20 to cause the traveler 70 to engage the bowstring 120 in the fired position and move the traveler relative to the stock to draw the bowstring to the cocked position.

The handle/grip assembly cooperates with a slide bar as set forth in the patents incorporated by reference. The traveler 70 can be carried by the slide bar which is moved relative to the stock or the traveler can be moved relative to the slide bar which is fixed relative to the stock 20.

The handle/grip assembly includes a driving lever, and a braking lever normally engaging the slide bar, the braking lever when engaging the slide bar preventing motion of the slide bar relative to the handle/grip assembly in in first direction (away), and when disengaging the slide bar allowing advancement of the handle/grip assembly in in first direction, the braking lever having an engaging portion extending outwardly from a hand grip, a trigger handle pivotably mounted to the hand grip rearwardly of the braking lever and contacting the driving lever, the engaged driving lever moving the slide bar and a second direction opposite the first direction, the handgrip having a trigger-type relationship with a trigger handle, the handle/grip assembly being holdable at the handgrip, the braking lever and the trigger handle being selectively operable by the same hand in such a manner that one of the index and middle fingers is positioned on the engaging portion of the braking lever to actuate the braking lever, while the other fingers encircle and contain the trigger handle and the handgrip.

Generally, this configuration provides moving the traveler 70 relative to the slide bar which is fixed relative to the stock 20 or moving the slide bar relative to the stock 20, where the traveler is fixed to the slide bar.

In one configuration, the traveler 70 is connected the slide bar as set forth in the incorporated references, where the traveler is thus movable toward and away from the bow assembly 100. The one-way drive means, by operation of the trigger handle grip, releasably engages the slide bar and advances the traveler (having engaged the bowstring 120) toward the cocking position. The one-way drive means is incapable of moving the slide bar and the traveler away from fired position of the bowstring. Return motion of the traveler 70 is accomplished manually when the bowstring is released from the traveler and the one-way drive means is disengaged. A first braking lever which is biased to bind against the slide bar prevents reverse motion of the traveler, except when the first lever is disengaged from the slide bar. Thus, for return motion of the traveler 70, it is necessary that both the one-way drive means and the first braking lever be disengaged. The trigger handle advances the slide bar by driving a second lever which binds against a surface of the slide bar and moves the slide bar as the second lever moves toward the grip. The second lever is returned by spring force to its original position after each stroke of the trigger handle, the second lever sliding over the bar surface during its return motion. In a further configuration, the handle/grip assembly is fixed relative to the stock 20, or the bow assembly 100, and configured such that actuation of the handle/grip assembly moves slide bar carrying the traveler 70.

Thus, the alternative configuration contemplates the crossbow having the stock 20 extending along a longitudinal direction and including the slide bar; the limb connected to the stock and moveable between a cocked position and a fired position; the bowstring connected to the limb; the trigger mechanism connected to the stock; the traveler moveable along the stock from a fired position to a cocked position, wherein the traveler includes the string capture surface, and a handle/grip assembly having a driving lever, and a braking lever normally engaging the slide bar, the braking lever when engaging the slide bar preventing motion of the slide bar relative to the handle/grip assembly in in first direction, and when disengaging the slide bar allowing advancement of the handle/grip assembly in in first direction, the braking lever having an engaging portion extending outwardly from a hand grip, a trigger handle pivotably mounted to the hand grip rearwardly of the braking lever and contacting the driving lever, the engaged driving lever moving the slide bar and a second direction opposite the first direction, the handgrip having a trigger-type relationship with a trigger handle, the handle/grip assembly being holdable at the handgrip, the braking lever and the trigger handle being selectively operable by the same hand in such a manner that one of the index and middle fingers is positioned on the engaging portion of the braking lever to actuate the braking lever, while the other fingers encircle and contain the trigger handle and the handgrip.

This configuration further provides a method of cocking a crossbow, the method including (a) engaging a handle/grip assembly with a slide bar, the handle/grip assembly having a driving lever, and a braking lever normally engaging the slide bar, the braking lever when engaging the slide bar preventing motion of the slide bar relative to the handle/grip assembly in in first direction, and when disengaging the slide bar allowing advancement of the handle/grip assembly in in first direction, the braking lever having an engaging portion extending outwardly from a hand grip, a trigger handle pivotably mounted to the hand grip rearwardly of the braking lever and contacting the driving lever, the engaged driving lever moving the slide bar and a second direction opposite the first direction; (b) moving a traveler engaged with one of the handle/grip assembly and the slide bar to engage a bowstring in a fired position of the bowstring; and (c) actuating the handle/grip assembly to move the traveler and the engaged bowstring to a cocked position.

This disclosure has been described in detail with particular reference to an embodiment, but it will be understood that variations and modifications can be effected within the spirit and scope of the disclosure. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A crossbow comprising:

(a) a stock extending along a longitudinal direction;

(b) a limb connected to the stock and moveable between a cocked position and a fired position;

(c) a bowstring connected to the limb;

(d) a trigger mechanism connected to the stock;

(e) a traveler moveable along the stock from a fired position to a cocked position, wherein the traveler includes (i) a string capture surface, (ii) a cocking pawl, and (iii) a first locking pawl;

(f) a first locking linear rack fixed relative to the stock and extending along the longitudinal direction, the first locking linear rack having a first plurality of teeth configured to cooperatively engage the locking pawl;

(g) a reciprocating linear rack moveably connected to the stock through a cocking cycle, the cocking cycle having an advancing portion and a releasing portion, the reciprocating linear rack including a plurality of teeth configured to engage the cocking pawl; and (h) a hand lever connected to the reciprocating linear rack and configured to move the reciprocating linear rack through the cocking cycle.

2. The crossbow of claim 1, further comprising a second locking linear rack fixed relative to the stock and extending along the longitudinal direction, the second locking linear rack having a second plurality of teeth.

3. The crossbow of claim 2, wherein the first locking pawl selectively engages the first locking linear rack and a second locking pawl selectively engages the second locking linear rack.

4. The crossbow of claim 1, wherein the traveler engages the trigger mechanism in the cocked position of the traveler.

5. The crossbow of claim 1, wherein the advancing portion of the cocking cycle moves the traveler and the reciprocating linear rack relative to the first locking linear rack.

6. The crossbow of claim 1, wherein in the releasing portion of the cocking cycle the traveler is (i) fixed relative to the first locking linear rack and (ii) moveable relative to the reciprocating linear rack.

7. The crossbow of claim 1, wherein in the advancing portion of the cocking cycle the cocking pawl is (i) engaged with the reciprocating linear rack and (ii) disengaged from the first locking linear rack.

8. A crossbow comprising:

(a) a stock extending along a longitudinal direction;

(b) a first locking linear rack fixedly connected to the stock, the first locking linear rack having a first plurality of teeth;

(c) a reciprocating linear rack moveably connected to the stock and configured to move through a cocking cycle having an advancing portion of the cocking cycle and a releasing portion of the cocking cycle, the reciprocating linear rack having a second set of teeth;

(d) a traveler moveable along the stock from a fired position to a cocked position, wherein the traveler includes (i) a first locking linear rack engaging surface configured to engage the first plurality of teeth and (ii) a reciprocating linear rack engaging surface configured to engage the second set of teeth; and (e) a hand lever connected to the reciprocating linear rack and configured to move the reciprocating linear rack through at least a portion of the cocking cycle.

9. The crossbow of claim 8, wherein the first locking linear rack engaging surface is a locking pawl.

10. The crossbow of claim 8, wherein the reciprocating linear rack engaging surface is a cocking pawl.

11. The crossbow of claim 8, wherein the hand lever is pivotally connected to the stock.

12. The crossbow of claim 8, further comprising a string capture surface carried by the traveler and configured to selectively capture a portion of a bowstring.

13. A method of cocking a crossbow, the method comprising:

(a) engaging a first portion of a traveler with a reciprocating linear rack moveably connected to a stock;

(b) moving the reciprocating linear rack through an advancing portion of a cocking cycle to move the traveler and the reciprocating linear rack relative to a first locking linear rack fixedly connected to the stock;

(c) engaging a second portion of the traveler with the first locking linear rack; and (d) moving the reciprocating linear rack through a releasing portion of the cocking cycle relative to the first locking linear rack and the traveler.

14. The method of claim 13, wherein the first portion of the traveler is cocking pawl and the second portion of the traveler is a locking pawl.

15. The method of claim 13, further comprising engaging a bowstring connected to a limb of the crossbow with the traveler.

16. The method of claim 13, wherein engaging the second portion of the traveler with the first locking linear rack precludes movement of the traveler in a first direction.

* * * * *